US012396484B2

(12) United States Patent
Courbat et al.

(10) Patent No.: US 12,396,484 B2
(45) Date of Patent: Aug. 26, 2025

(54) AEROSOL-GENERATING ARTICLE WITH A MULTI- COMPARTMENT LIQUID RESERVOIR

(71) Applicant: Philip Morris Products S.A., Neuchatel (CH)

(72) Inventors: Jerome Christian Courbat, Cortaillod (CH); Oleg Mironov, Cudrefin (CH); Ozgur Ozsun, Kilchberg (CH)

(73) Assignee: Philip Morris Products S.A., Neuchatel (CH)

( * ) Notice: Subject to any disclaimer, the term of this patent is extended or adjusted under 35 U.S.C. 154(b) by 403 days.

(21) Appl. No.: 17/998,116

(22) PCT Filed: May 12, 2021

(86) PCT No.: PCT/EP2021/062570
§ 371 (c)(1),
(2) Date: Nov. 7, 2022

(87) PCT Pub. No.: WO2021/228912
PCT Pub. Date: Nov. 18, 2021

(65) Prior Publication Data

US 2023/0172267 A1 Jun. 8, 2023

(30) Foreign Application Priority Data

May 15, 2020 (EP) ..... 20175050

(51) Int. Cl.
*A24F 40/10* (2020.01)
*A24F 7/00* (2006.01)
(Continued)

(52) U.S. Cl.
CPC ..... *A24F 40/42* (2020.01); *A24F 7/00* (2013.01); *A24F 40/10* (2020.01); *A24F 40/48* (2020.01);
(Continued)

(58) Field of Classification Search
CPC ..... A24F 40/42; A24F 40/10; A24F 40/48; A24F 40/70; A24F 40/485; A24F 40/465;
(Continued)

(56) References Cited

U.S. PATENT DOCUMENTS 10,743,589 B1 * 8/2020 Hermiz ..... A24F 40/30
2015/0144145 A1 * 5/2015 Chang ..... A24F 40/46 131/328
(Continued)

FOREIGN PATENT DOCUMENTS

CN 204245158 U 4/2015
CN 107397998 A 11/2017
(Continued)

OTHER PUBLICATIONS

English Machine Translation for CN209251767U (Year: 2019).*
(Continued)

*Primary Examiner* — Philip Y Louie
*Assistant Examiner* — Oluwatosin O Diyan
(74) *Attorney, Agent, or Firm* — Oblon, McClelland, Maier & Neustadt, L.L.P.

(57) ABSTRACT

An aerosol-generating article for an aerosol-generating device is provided, the article including: an open-ended hollow-cylindrical reservoir body including a tubular outer wall and an inner partition wall extending between two opposing inner portions of the outer wall so as to partition an inner void of the body into first and second compartments, which are laterally arranged adjacent to each other along a longitudinal axis of the body; a first end cap attached to a first end of the body that sealingly closes at least the first compartment at the first end; and a second end cap attached to a second end of the body that sealingly closes the first and the second compartments at the second end, the second end
(Continued)

cap including a fluid passage providing a fluid communication between the first and the second compartments.

19 Claims, 4 Drawing Sheets

(51) Int. Cl.

| | |
|---|---|
| ***A24F 40/42*** | (2020.01) |
| ***A24F 40/48*** | (2020.01) |
| ***A24F 40/70*** | (2020.01) |
| ***B65B 3/02*** | (2006.01) |
| ***B65B 3/04*** | (2006.01) |
| ***B65B 7/00*** | (2006.01) |
| ***B65B 7/28*** | (2006.01) |

(52) U.S. Cl.
CPC ..... *A24F 40/70* (2020.01); *B65B 3/022* (2013.01); *B65B 3/04* (2013.01); *B65B 7/28* (2013.01)

(58) Field of Classification Search
CPC .. A24F 7/00; B65B 3/022; B65B 3/04; B65B 7/28; B29C 48/03
See application file for complete search history.

(56) References Cited

U.S. PATENT DOCUMENTS

| | | | | |
|---|---|---|---|---|
| 2017/0064994 | A1* | 3/2017 | Xu | B65D 81/3222 |
| 2018/0213847 | A1* | 8/2018 | Reevell | A24F 40/30 |
| 2019/0116883 | A1* | 4/2019 | Rogan | A24F 40/46 |

FOREIGN PATENT DOCUMENTS

| | | | |
|---|---|---|---|
| CN | 104544570 | B | 12/2017 |
| CN | 209251767 | U | 8/2019 |
| CN | 209261767 | U | 8/2019 |
| JP | 2019-501667 | A | 1/2019 |
| RU | 2 719 204 | C2 | 4/2020 |
| WO | WO 2015/175568 | A1 | 11/2015 |
| WO | WO 2018/141466 | A1 | 8/2018 |
| WO | WO 2018/146738 | A1 | 8/2018 |

OTHER PUBLICATIONS

International Search Report & Written Opinion issued Sep. 14, 2021 in PCT/EP2021/062570, filed on May 12, 2021, 14 pages.
Russian Search Report issued Aug. 22, 2024 in Russian Patent Application No. 2022132674/03 (with English Translation of Category of Cited Documents), 3pages.
Japanese Office Action issued Mar. 13, 2025 in Japanese Patent Application No. 2022-567764 (with unedited computer-generated English Translation), 7 pages.

* cited by examiner

AEROSOL-GENERATING ARTICLE WITH A MULTI- COMPARTMENT LIQUID RESERVOIR

The present disclosure relates to an aerosol-generating article for use with an aerosol-generating device which comprises a liquid reservoir for storing an aerosol-forming liquid. The present disclosure also relates to an aerosol-generating system comprising such an article and an aerosol-generating device for use with the article. The present disclosure further relates a method of manufacturing such an article.

Generating inhalable aerosols by heating aerosol-forming liquids is generally known from prior art. For this, a liquid aerosol-forming substrate may be conveyed by a liquid conduit, for example a wick element, from a liquid reservoir into a region outside the reservoir. There, the liquid may be vaporized by a heater and subsequently exposed to an air path such as to form an inhalable aerosol. Both, the liquid reservoir and the liquid conduit may be part of an aerosol-generating article that is configured to be inserted into an aerosol-generating device in order to vaporize the aerosol-forming liquid stored in the article. For various purposes the liquid reservoir may be partitioned into several compartments, for example, in order to store a plurality of aerosol-forming liquids in the article or to provide several portions each having a specific function. There are various configurations of such multi-compartment aerosol-generating articles. However, many of these configurations are complex and thus laborious to manufacture.

Therefore, it would be desirable to have an aerosol-generating article comprising a multi-compartment liquid reservoir with the advantages of prior art solutions, whilst mitigating their limitations. In particular, it would be desirable to have an aerosol-generating article with a multi-compartment liquid reservoir which is easy and inexpensive to manufacture.

According to the present invention, there is provided an aerosol-generating article for use with an aerosol-generating device. The article comprises an open-ended tubular, in particular hollow-cylindrical reservoir body comprising a tubular outer wall and an inner partition wall extending between two opposing inner portions of the tubular outer wall such as to partition the inner void of the reservoir body into a first compartment and a second compartment. The first compartment and the second compartment are laterally arranged adjacent to each other along a longitudinal axis of the reservoir body. In addition, the article comprises a first end cap attached to a first end of the reservoir body, which sealingly closes at least the first compartment at the first end of the reservoir body. The article further comprises a second end cap attached to a second end of the reservoir body, which sealingly closes the first compartment and the second compartment at the second end of the reservoir body. The second end cap comprises a fluid passage providing a fluid communication between the first compartment and the second compartment.

According to the invention it has been found that the manufacturing of an article may be facilitated by assembling the article from individual parts which are easy and inexpensive to manufacture when manufactured separately. In that sense, the article may be easily manufactured by manufacturing the open-ended hollow-cylindrical reservoir body, the first end cap and the second end cap separately and by subsequently attaching the first end cap to the first end of the reservoir body and the second end cap to the second end of the reservoir body. That is, the reservoir body, the first end cap and the second end cap are separate parts, in particular non-integral parts, that is, not formed integrally with each other. In particular, the reservoir body, the first end cap and the second end cap are separate from each other prior to attaching the first end cap to the first end of the reservoir body and the second end cap to the second end of the reservoir body. Yet, even after attaching the first end cap to the first end of the reservoir body and the second end cap to the second end of the reservoir body, the reservoir body, the first end cap and the second end cap are still separate (non-integral) parts, in particular not formed integrally with each other. The manufacture is also simplified by the fact that the reservoir body is open-ended and hollow-cylindrical. That is, at least the tubular outer wall has a cylindrical shape and thus a fixed cross-sectional shape along its longitudinal axis, that is, along the longitudinal axis (cylinder axis) of the reservoir body. Due to this, at least the tubular outer wall of the reservoir body may be manufactured by extrusion. Subsequently, the inner partition wall may be installed between two opposing inner portions of the tubular outer wall such as to partition the inner void of the reservoir body into first compartment and a second compartment. Accordingly, the reservoir body is at least partially an extruded body. In this configuration, the tubular outer wall and the partition wall may be attached to each other by an adhesive bond, for example, by welding or gluing. Advantageously, the adhesive bond provides a sealing between the first compartment and the second compartment, where the partition wall and the tubular outer wall come together.

Preferably, the partition wall is parallel to the longitudinal axis of the reservoir body. That is, the cross-sectional profiles of the tubular outer wall and the inner partition wall are fixed along the longitudinal axis of the reservoir body. As a consequence, the reservoir body as a whole has a fixed cross-sectional profile along its longitudinal axis. Advantageously, this allows for manufacturing the entire reservoir body by extrusion. Accordingly, the reservoir body, as a whole, may be an extruded body. In particular, the tubular outer wall and the inner partition wall may be integral with each other. Accordingly, the reservoir body as a whole may be extruded in one. That is, the reservoir body may be a one-piece extruded body. A one-piece extruded reservoir body is particularly easy and inexpensive to manufacture. In addition, a one-piece extruded reservoir body does not require a sealing between the first compartment and the second compartment, where the partition wall and the tubular outer wall come together.

Alternatively, the tubular outer wall and the inner partition wall may be manufactured as separate parts by extrusion. Subsequently, the extruded inner partition wall may be installed between two opposing inner portions of the extruded tubular outer wall such as to partition the inner void of the reservoir body into first compartment and a second compartment. Preferably, as already described above, the tubular outer wall and the partition wall may be attached to each other by an adhesive bond, for example, by welding or gluing.

The main advantages of extrusion over other manufacturing processes are its ability to create complex cross-sections, and to work materials that are brittle, because the material only encounters compressive and shear stresses during the extrusion presses. Extrusion also forms parts with a good surface finish.

In general, extrusion may be continuous or semi-continuous. Semi-continuous extrusion allows for a direct manufacturing of many individual pieces. In contrast, continues extrusion allows for the production of a continuous body profile, which subsequently may be separated into individual bodies, for, by cutting. Hence, irrespective of the reservoir body being an extruded body only partially or as a whole, the reservoir body may be manufactured either by continuous extrusion or by semi-continues extrusion.

It is also possible that the reservoir body, in particular at least one of the tubular outer wall and the inner partition, are manufactured by injection molding. Likewise, at least one of the first end cap and the second end cap may be manufactured by injection molding. Depending on the their shape, it is also possible that at least one of the first end cap and the second end cap are manufactured by extrusion.

The tubular outer wall and thus the reservoir body may have any outer cross-sectional shape. The outer cross-sectional shape refers to the shape of the outline of the tubular outer wall and the reservoir body as seen in a cross-sectional view through the tubular outer wall and the reservoir body perpendicular to the the longitudinal axis of the reservoir body. Accordingly, the reservoir bod, in particular the tubular outer wall may have a circular, an ellipsoidal, an oval, a triangular, a rectangular, a quadratic, a hexagonal or a polygonal outer cross-sectional shape.

An arrangement of the inner partition wall within the tubular outer wall may be asymmetric with respect to a cross-section of the reservoir body perpendicular to the longitudinal axis of the reservoir body. This configuration may be used to realize a first compartment and a second compartment having different volumes. That is, the first compartment may have a volume that is different from, in particular larger or smaller than a volume of the second compartment.

Different volumes of the first and the second compartment may be used to store different amounts of aerosol-forming in the article. For example, the first compartment may have a volume that is smaller than a volume of the second compartment. In this configuration, the first compartment may be used as a main reservoir whereas the second compartment may be used at least partially as a buffer reservoir. Details of this configuration will be described in more detail further below.

The asymmetric arrangement of the partition wall may also prove advantageous in case one of the first compartment or the second compartment serves at least partially as a vaporization zone in which aerosol forming liquid may be vaporized by inductive heating using a susceptor within the vaporization zone. Accordingly, the article may comprise a vaporization zone including a susceptor which is arranged off-center with regard to a geometrical center axis of the aerosol-generating article. Due to this, the vaporization zone and the susceptor may be arrangeable off-center with regard to a symmetry axis of an alternating magnetic field generated by an inductively heating aerosol-generating device into which the aerosol-generating article may be inserted for heating the aerosol forming liquid within the vaporization zone. Advantageously, due to the off-center arrangement, the vaporization zone and the susceptor are arranged in a region of the alternating magnetic field having a higher field density as compared to a symmetric center arrangement. As a consequence, the heating efficiency is enhanced.

A length extension of the inner partition wall in a direction parallel to the longitudinal axis of the reservoir body may equal to a length extension of the tubular outer wall. Advantageously, this configuration is particularly easy and inexpensive to manufacture, in particular by extrusion.

Likewise, a length extension of the inner partition wall and a direction parallel to the longitudinal axis of the reservoir body may be shorter than a length extension of the tubular outer wall. That is, the inner partition wall may be recessed with respect to the outer tubular wall along its length extension. A recessed inner partition wall advantageously may provide a direct fluid communication between the first compartment and the second compartment.

The first end cap may comprise an outlet providing a fluid communication between the second compartment and the outside of the article. The outlet may serve as an outlet for aerosol-forming liquid stored within the article. Likewise, the outlet may serve as an outlet for aerosol, which is generated within the aerosol-generating article from aerosol-forming liquid stored therein, to escape from the article, in particular to be drawn out from the article.

In particular with regard to the latter case, the aerosol-generating article may further comprise a filter that is arranged in or attached to the outlet. The filter may be used to filter out undesired components of the aerosol. The filter may also comprise an add-on material, for example, a flavor material to be added to the aerosol.

The aerosol-generating article further comprises a mouthpiece. As used herein, the term "mouthpiece" means a portion of the article that is placed into a user's mouth in order to directly inhale an aerosol from the article. The mouthpiece may be a separate part attached to the other parts of the article in particular to the first end cap. In this configuration, the outlet of the first end cap may open out into the mouthpiece, and the mouthpiece may comprise another outlet through which aerosol may escape from the article into the environment of the article. Alternatively, the first and May be formed as a mouthpiece. In this configuration, the outlet of the first end cap may open out into the environment of the article, allowing a result escape therethrough. If present, the mouthpiece preferably comprises a filter. The filler may be the filter described above is arranged in or attached to the outlet of the first end cap.

The reservoir body may be made of any suitable material. Preferably, the material of the reservoir body is at least one of electrically insulating and non-magnetic. For example, the reservoir body may comprise or may be made of one of PP (polypropylene), PE (polyethylene) or PET (polyethylene terephthalate). PP, PE and PET are particularly cost-effective and easy to mold, in particular to extrude. The reservoir body may also comprise or may also be made of PEEK (polyether ether ketone), which is a heat resistant material. Furthermore, the material of the reservoir body may have a thermal conductivity, in particular thermal conductivity below 0.05 Watt per meter and per Kelvin ($W \cdot m^{-1} \cdot K^{-1}$). This prevents a user from burning when the aerosol-forming liquid within the article is heated. Preferably, the reservoir body is made of plastic, in particular a heat resistant plastic. At least one of the first end cap and the second end cap may be made of silicone, PP (polypropylene), PET (polyethylene terephthalate) or PE (polyethylene). Using silicone may facilitate to sealingly close the first and the second compartment, respectively.

The first end cap may be attached to the reservoir body by at least one of a form fit, a force fit or an adhesive bond. Likewise, the second end cap may be attached to the reservoir body by at least one of a form fit, a force fit or an adhesive bond. With regard to an adhesive bond, at least one of the first end cap and the second end cap may be attached to the reservoir body by glue or welding, in particular laser welding or ultrasound welding. As an example of a force fit, at least one of the first end cap and the second end cap may be clamped to the reservoir body. As an example of a form fit, at least one of the first end cap and the second end cap may be attached to the reservoir body by a snap-in connection.

The fluid passage of the second end cap may comprise a recess or a channel formed in the second end cap in order to provide a fluid communication between first compartment and the second compartment. At least a part of the fluid passage of the second end cap may be used to form a capillary buffer reservoir.

Advantageously, the fluid communication between the first compartment and the second compartment other may be used to have the first compartment and the second compartment cooperating with each other, each with a specific function, as will be now described in more detail.

In respect of this, the first compartment or at least a part thereof may be used as a main reservoir for storing aerosol-forming liquid. At least a part of the second compartment may be used as a capillary buffer reservoir in fluid communication with the main reservoir realized by the first compartment or part thereof. The capillary buffer may be configured for storing aerosol-forming liquid due to capillary action in order to reliably provide a liquid conduit in fluid communication with the buffer reservoir with a sufficient amount of aerosol-forming liquid, independent of the article position. For this, the volume of the buffer reservoir is chosen such that capillary effects dominate over gravity. As a consequence, once having been filled into the buffer reservoir, aerosol-forming liquid is prevented from flowing back into the main reservoir, in particular when the orientation of the article is changed, for example, from a substantially upright position into a substantially horizontal position or even into an upside down position. Basically the capillary buffer reservoir acts like a buffer reservoir of a fountain pen.

In order to have the capillary action dominating over gravity, at least one dimension of the second compartment may be chosen to be on the order of the effective capillary length for the aerosol-forming liquid to be stored in the buffer reservoir. Typically, the effective capillary length is in the range of a few millimeters for most liquids. Accordingly, a maximum dimension of the second compartment between two opposing portions of the partition wall and the tubular outer wall may be in range between 0.2 millimeter and 5 millimeter, in particular between 0.5 millimeter and 3 millimeter, preferably between 1 millimeter and 2.5 millimeter. These values ensure sufficient capillary action, whilst still enabling to provide a sufficiently large buffer volume for storing a sufficient amount of aerosol-forming liquid.

The capillary buffer reservoir may have a total volume of up to 60 cubic millimeters, in particular up to 50 cubic millimeters, preferably up to 40 cubic millimeters, more preferably up to 30 cubic millimeters, most preferably up to 20 cubic millimeters. These volumes still ensure proper capillary action Vice versa, the total volume of the capillary buffer reservoir may be at least 5 cubic millimeters, in particular at least 10 cubic millimeters, preferably at least 15 cubic millimeters. These volumes are still large enough to trap and provide a sufficient amount of aerosol-forming liquid in the capillary buffer reservoir lasting at least for a few puffs.

As mentioned further below, the volume of the first compartment may be different from a volume of the second compartment. Preferably, the volume of the first compartment is larger than a volume of the second compartment. This configuration is advantageously is the first compartment is used as a main buffer and a part of the second compartment is used as a capillary buffer reservoir. The volume of the second compartment may at most 50 percent, in particular at most 40 percent, preferably at most 30 percent, more preferably at most 20 percent of the volume of the first compartment.

As also mentioned further above, the buffer reservoir may only be a part of the second compartment. The other part of the second compartment may be used as a vaporization zone. The vaporization zone may be zone in which the conveyed aerosol-forming liquid may be vaporized in use of the article with an aerosol-generating device. Accordingly, the aerosol-generating article may comprise a vaporization zone, in particular a vaporization cavity, for vaporizing aerosol-forming liquid. Preferably, the vaporization zone and the buffer reservoir are separated from each other. Accordingly, the aerosol-generating article may comprise a bushing arranged within the second compartment transverse, in particular perpendicular to the longitudinal axis of the reservoir body, wherein the bushing partitions the second compartment into a vaporization zone and a buffer reservoir.

The second compartment may be used entirely as a vaporization zone. In this configuration, the capillary buffer reservoir may be formed, for example, by at least a part of the fluid passage in the second end cap which provides a fluid communication between the first and the second compartment.

The aerosol-generating article may further comprise a liquid conduit for conveying aerosol-forming liquid from the buffer reservoir to the vaporization zone. Preferably, the liquid conduit passes through the bushing. The liquid conduit may pass into the vaporization zone. Alternatively, the liquid conduit may face the vaporization zone. Likewise, the liquid conduit may pass into the buffer reservoir. Alternatively, the liquid conduit may face the buffer reservoir. As used herein, the term "face the buffer reservoir/vaporization zone" refers to a configuration in which the liquid conduit is in fluid communication with, but does not pass into the buffer reservoir and the vaporization zone, respectively.

With regard to a liquid flow through the article, the capillary buffer reservoir preferably is downstream of the main reservoir. Likewise, the liquid conduit preferably is downstream of the capillary buffer reservoir with regard to a liquid flow through the article.

Further with regard to a liquid flow through the article, at least a portion of the fluid conduit is arranged at or in a downstream portion of the capillary buffer reservoir. Advantageously, this arrangement ensures that the liquid conduit is properly immersed in the aerosol-forming liquid trapped in the capillary buffer reservoir. This in turn ensures a proper delivery of aerosol-forming liquid form the buffer reservoir into the region outside the main reservoir and the buffer reservoir where the aerosol-forming liquid may be vaporized.

In general, the liquid conduit may have any shape and configuration suitable to convey aerosol-forming liquid from the capillary buffer reservoir to the vaporization zone. In particular, the liquid conduit may comprise a wick element. The configuration of the wick element may be a stranded wire, a stranded rope of material, a mesh, a mesh tube, several concentric mesh tubes, a cloth, sheets of material, or a foam (or other porous solid) with sufficient porosity, a roll of fine metal mesh or some other arrangement of metal foil, fibers or mesh, or any other geometry that is appropriately sized and configured to carry out the wicking action as described herein.

The liquid conduit, in particular the wick element, may comprise a filament bundle including a plurality of filaments. Preferably, the filament bundle is an unstranded filament bundle. In an unstranded filament bundle, the filaments of the filament bundle run next to each other without crossing each other, preferably along the entire length extension of the filament bundle. Likewise, the filament bundle may comprise a stranded portion, in which the filaments of the filament bundle are stranded. A stranded portion may enhance the mechanical stability of the filament bundle.

As an example, the filament bundle may comprise a parallel-bundle portion along at least a portion of its length extension in which the plurality of filaments may be arranged parallel to each other. The parallel-bundle portion may be arranged at one end portion of the filament bundle or between both end portions of the filament bundle. Alternatively, the parallel-bundle portion may extend along the entire length dimension of the filament bundle.

As another example, the filament bundle may comprise a first soaking section, a second soaking section and an intermediate section between the first soaking section and the second soaking section. Along at least the intermediate section the plurality of filaments may be arranged parallel to each other. With regard to the specific configuration of the article having a reservoir and a vaporization zone, each of the first soaking section and the second soaking section may be arranged at least partially in the reservoir, while the intermediate section may be arranged in the vaporization zone. This holds at least for the open configuration of the sealing element.

Using filaments for conveying liquids is particularly advantageous because filaments inherently provide a capillary action. Moreover, in a filament bundle, the capillary action is further enhanced due to the narrow spaces formed between the pluralities of filaments when being bundled. In particular, this applies for a parallel arrangement of the filaments along which the capillary action is constant as the narrow spaces between the filaments do not vary along the parallel arrangement.

Preferably, the filaments are solid material filaments. Solid material filaments are inexpensive and easy to manufacture. In addition, solid material filaments provide a good mechanical stability, thus making the filament bundle robust. In general, the filaments may have any cross-sectional shape suitable for conveying aerosol-forming liquid, in particular when being bundled. Accordingly, the filaments may have a circular, an ellipsoidal, an oval, a triangular, a rectangular, a quadratic, a hexagonal or a polygonal cross-section. Preferably, the filaments have a substantially circular, oval or elliptically cross-section. Having such a cross-section, the filaments are not in area contact, but only in a line contact with each other causing the formation of capillary spaces between the pluralities of filaments on its own.

The capillary action generally relies on a reduction in the surface energy of the two separate surfaces, the liquid surface and the solid surface of the filaments. The capillary action includes an effect that depends on the radius of curvature of both the liquid surface and the filaments. Hence, there may be a need for large surface areas and small radii of curvature, both of which are achieved by a small diameter of the filaments. Accordingly, the plurality of first filaments may have a diameter of at most 0.025 millimeter, at most 0.05 millimeter, at most 0.1 millimeter, at most 0.15 millimeter, at most 0.2 millimeter, at most 0.25 millimeter, at most 0.3 millimeter, at most 0.35 millimeter, at most 0.4 millimeter, at most 0.45 millimeter or at most 0.5 millimeter.

In general, the filament bundle may be a linear filament bundle, that is, a substantially straight, non-curved or non-bent filament bundle. This configuration does not exclude little bending of the filament bundle, that is, large curvature radii along the length extension of the filament bundle. As used herein, large curvature radii may include curvature radii being 10 times, in particular 20 times or 50 times or particular 100 times larger than the total length of the filament bundle. Alternatively, the filament bundle may be curved. In particular, the filament bundle may be substantially U-shaped or C-shaped or V-shaped.

The plurality of filaments may be surface treated. In particular, the plurality of filaments may comprise at least partially a surface coating, for example, an aerosolization enhancing surface coating, a liquid-adhesive surface coating, a liquid repellent surface coating, or an antibacterial surface coating. The aerosolization enhancing surface coating advantageously may in particular enhance the variety of a user's experience. The liquid adhesive surface coating may be beneficial with regard to an enhancement of the capillary action of the filament bundle. The antibacterial surface coating may serve to reduce a bacterial contamination. A liquid repellent coating, in particular at an extremity of the filaments, may avoid liquid dropping.

Depending on the available space, the dimensions of the filaments and the amount of aerosol-forming liquid to be conveyed and heated, the filament bundle may comprise 3 to 100 filaments, in particular 10 to 80 filaments, preferably 20 to 60 filaments, more preferably 30 to 50 filaments, for example 40 filaments.

As yet another example, the liquid conduit may comprise two filament arrays crossing each other partially. In particular, the liquid conduit may comprise an array of longitudinal filaments arranged side by side as well as an array of transverse filaments arranged side by side and crossing the array of longitudinal filaments transverse to a length extension of the longitudinal filaments. The array of transverse filaments may only extend along a length portion of the array of longitudinal filaments such that the liquid conduit comprises at least one grid portion and at least one non-grid portion. As an example, the array of longitudinal filaments may have a substantially cylindrical shape, in particular hollow-cylindrical shape. As another example, the array of longitudinal filaments may have a substantially conical shape or a substantially frustoconical shape, in particular a substantially hollow-conical shape or a substantially hollow-frustoconical shape. In any of these configurations, the longitudinal filaments form the shell surface of the cylindrical, conical, frustoconical, hollow-cylindrical, hollow-conical or hollow-frustoconical shape, respectively. The length axis of the respective shape extends substantially along the length extension of the longitudinal filaments. Advantageously, any of the aforementioned shapes provides an inherent mechanical dimensional stability. The array of transverse filaments preferably has a substantially ring shape in any of these configurations. That is, the transverse filaments extend along the circumference of the cylindrically, conically, frustoconically, hollow-cylindrical, hollow-conically or hollow-frustoconically shaped array of longitudinal filaments in the grid portion of the susceptor assembly. Seen as a whole, the susceptor assembly has a substantially crown shape in any of the afore-mentioned configurations. Furthermore, in case of conical, frustoconical, hollow-conical or hollow-frustoconical shape, the longitudinal filaments diverge from each other towards the base of the respective shape. Therefore, a conically, frustoconically, hollow-conically or hollow-frustoconically shaped array of longitudinal filaments facilitates providing a fan-out portion.

Preferably, the liquid conduit may be inductively heatable. As such, the liquid conduit advantageously is capable to perform both functions: conveying and heating an aerosol-forming liquid. Advantageously, this double function allows for a very material saving and compact design of the liquid conduit without separate means for conveying and heating. In addition, there is a direct thermal contact between the heat source, that is, the liquid conduit and the aerosol-forming liquid adhering thereto. Unlike in case of a heater in contact with a saturated wick, a direct contact between the liquid conduit and a small amount of liquid advantageously allows for flash heating, that is, for a fast onset of evaporation. To this extent, the liquid conduit may be considered to be or to comprise a liquid-conveying susceptor assembly. As used herein, the term "inductively heatable" refers to a liquid conduit comprising a susceptor material that is capable to convert electromagnetic energy into heat when subjected to an alternating magnetic field. This may be the result of at least one of hysteresis losses or eddy currents induced in the susceptor material, depending on its electrical and magnetic properties. Hysteresis losses occur in ferromagnetic or ferrimagnetic susceptor materials due to magnetic domains within the material being switched under the influence of an alternating electromagnetic field. Eddy currents are induced in electrically conductive susceptor materials. In case of an electrically conductive ferromagnetic or ferrimagnetic susceptor material, heat is generated due to both, eddy currents and hysteresis losses.

Accordingly, the inductively heatable liquid conduit may comprise at least a first susceptor material. The first susceptor material may comprise or may be made of a material that is at least one of electrically conductive and ferromagnetic or ferrimagnetic, respectively. That is, the first susceptor material may comprise or may be made of one of a ferrimagnetic material, or a ferromagnetic material, or an electrically conductive material, or electrically conductive ferrimagnetic material or electrically conductive ferromagnetic material.

In addition, the liquid conduit may comprise a second susceptor material. While the first susceptor material may be optimized with regard to heat loss and thus heating efficiency, the second susceptor material may be used as temperature marker. For this, the second susceptor material preferably comprises one of a ferrimagnetic material or a ferromagnetic material. In particular, the second susceptor material may be chosen such as to have a Curie temperature corresponding to a predefined heating temperature. At its Curie temperature, the magnetic properties of the second susceptor material change from ferromagnetic or ferrimagnetic to paramagnetic, accompanied by a temporary change of its electrical resistance. Thus, by monitoring a corresponding change of the electrical current absorbed by the induction source it can be detected when the second susceptor material has reached its Curie temperature and, thus, when the predefined heating temperature has been reached. Preferably, the first susceptor material is different from the second susceptor material. The second susceptor material preferably has a Curie temperature that is lower than 500 degree Celsius. In particular, the second susceptor material may have a Curie temperature below 350 degree Celsius, preferably below 300 degree Celsius, more preferably below 250 degree Celsius, even more preferably below 200 degree Celsius, most preferably below 150 degree Celsius. Preferably, the Curie temperature is chosen such as to be below the boiling point of the aerosol-forming liquid to be vaporized in order to prevent the generation of hazardous components in the aerosol.

As an example, the liquid conduit may comprise a plurality of first filaments comprising or being made of the first susceptor material. In addition, the liquid conduit may comprise a plurality of second filaments comprising or being made of the second susceptor material. To sufficiently work as temperature marker, only a few second filaments are required. Accordingly, the number of first filaments may be larger, in particular two times or three times or four times or five times or six times or seven times or eight times or nine times or ten times larger than the number of second filaments. Preferably, the diameter of the first and second filaments should be larger than twice the skin depth in order to induce a sufficient amount of eddy currents and thus to generate a sufficient amount of heat energy when being exposed to an alternating magnetic field. The skin depth is a measure of how far electrical conduction takes place in an electrically conductive susceptor material when being inductively heated. Accordingly, depending on the materials and the frequency of the alternating magnetic field used, the first and second filaments may have a diameter of at least 0.015 millimeter, at least 0.02 millimeter, at least 0.025 millimeter at least 0.05 millimeter, at least 0.075 millimeter, at least 0.1 millimeter, at least 0.125 millimeter, at least 0.15 millimeter, at least 0.2 millimeter, at least 0.3 millimeter or at least 0.4 millimeter. The second filaments may be randomly distributed throughout the liquid conduit. Advantageously, a random distribution requires only little effort during manufacturing of the liquid conduit.

The plurality of first filaments and the optional plurality of second filaments described before may be used in any of the configurations of the liquid conduit described above, for example, in a filament bundle comprising at least one parallel-bundle portion, in a filament bundle comprising two soaking sections and an intermediate portion or in liquid conduit comprising two filament arrays crossing each other partially such as to form at least one grid portion and at least one non-grid portion.

In case the liquid conduit is inductively heatable, it may be arranged off-center with regard to a geometrical center axis of the aerosol-generating article, as already described further above. Due to this, the liquid conduit may be arrangeable off-center with regard to a symmetry axis of an alternating magnetic field generated by an inductively heating aerosol-generating device into which the aerosol-generating article may be inserted for heating the liquid conduit. Advantageously, due to the off-center arrangement, that is, an asymmetric arrangement, the liquid conduit is arranged in a region of the alternating magnetic field having a higher field density as compared to a symmetric center arrangement. As a consequence, the heating efficiency is enhanced.

The aerosol-generating article may be an aerosol-generating article for single use or an aerosol-generating article for multiple uses. In the latter case, the aerosol-generating article may be refillable. That is, the main reservoir may be refillable with an aerosol-forming liquid. In any configuration, the aerosol-generating article may further comprise an aerosol-forming liquid contained at least in the first compartment. The aerosol-forming liquid may also be contained in at least a part of the second compartment.

As used herein, the term "aerosol-forming liquid" relates to a liquid capable of releasing volatile compounds that can form an aerosol upon heating the aerosol-forming liquid. The aerosol-forming liquid is intended to be heated. The aerosol-forming liquid may contain both, solid and liquid aerosol-forming material or components. The aerosol-forming liquid may comprise a tobacco-containing material containing volatile tobacco flavor compounds, which are released from the liquid upon heating. Alternatively or additionally, the aerosol-forming liquid may comprise a non-tobacco material. The aerosol-forming liquid may further comprise an aerosol former. Examples of suitable aerosol formers are glycerin and propylene glycol. The aerosol-forming liquid may also comprise other additives and ingredients, such as nicotine or flavourants. In particular, the aerosol-forming liquid may include water, solvents, ethanol, plant extracts and natural or artificial flavors. The aerosol-forming liquid may be a water-based aerosol-forming liquid or an oil-based aerosol-forming liquid.

To facilitate the fluid flow around the end of the partition wall facing the bottom end cap, an end face of the partition wall at the second end of the reservoir body may be rounded, in particular may comprise rounded edges. In particular, rounded edges facilitate air seeping into the reservoir to flow around the end of the partition. In contrast, sharp edges could be bubble trappers due to pinning of the contact line.

According to the invention, there is also provided an aerosol-generating system comprising an aerosol-generating device and an aerosol-generating article according to the present invention and as described herein. The article is configured for use with the aerosol-generating device.

As used herein, the term "aerosol-generating device" is used to describe an electrically operated device that is capable of interacting with at least one aerosol-generating article including at least one aerosol-forming liquid such as to generate an aerosol by heating the aerosol-forming liquid within the article. Preferably, the aerosol-generating device is a puffing device for generating an aerosol that is directly inhalable by a user through the user's mouth. In particular, the aerosol-generating device is a hand-held aerosol-generating device.

The device may comprise a receiving cavity for removably receiving at least a portion of the aerosol-generating article.

In addition, the aerosol-generating device may comprise an electrical heating arrangement. The heating arrangement may be configured for heating aerosol-forming liquid contained in the article. In particular, the heating arrangement may be configured for heating aerosol-forming liquid conveyed by the liquid conduit from the reservoir to a region outside the buffer reservoir, in particular to a vaporization zone as described above.

The heating arrangement may be a resistive heating arrangement comprising a resistive heating element for heating the aerosol-forming liquid. The resistive heating element may be, for example, a heating wire or a heating coil. In use, the resistive heating element is arranged in thermal contact or thermal proximity to the aerosol-forming liquid to be heated. In particular, the resistive heating element may be arranged in thermal contact or thermal proximity to a liquid conduit, in particular to a part of the liquid conduit which is arranged in a vaporization zone of the aerosol-generating article, when the aerosol-generating article is received in the aerosol-generating device.

Alternatively, the heating arrangement may be an inductive heating arrangement. That is, the aerosol-generating device may be an inductively heating aerosol-generating device. This configuration is particularly preferred in case the liquid conduit of the article is inductively heatable. Inductive heating may also work in case the aerosol-generating article comprises a (separate) susceptor element which is arranged in thermal contact or thermal proximity to the liquid conduit, in particular to a part of the liquid conduit which is arranged in a vaporization zone of the aerosol-generating article. It is also possible that the aerosol-generating device itself comprises a susceptor element which is arranged in thermal contact or thermal proximity to the liquid conduit, in particular to a part of the liquid conduit which is arranged in a vaporization zone of the aerosol-generating article, when the aerosol-generating article is received in the aerosol-generating device. In the latter configuration, that is, in case the liquid conduit itself is not inductively heatable, the susceptor element may be, for example, a susceptor sleeve or a susceptor coil surrounding the liquid conduit, in particular a part of the liquid conduit which is arranged in a vaporization zone of the aerosol-generating article.

The inductively heating aerosol-generating device, in particular the inductive heating arrangement may comprise at least one induction source configured and arranged to generate an alternating magnetic field in the receiving cavity in order to inductively heat the aerosol-forming liquid in the aerosol-generating article, when the article is received in the aerosol-generating device.

For generating the alternating magnetic field, the induction source may comprise at least one inductor, preferably at least one induction coil arranged around the receiving cavity. In case the liquid conduit is inductively heatable, the induction coil is arranged around the liquid conduit when the article is received in the receiving cavity, in particular around a part of the liquid conduit which is arranged in a vaporization zone of the aerosol-generating article.

The at least one induction coil may be a helical coil or flat planar coil, in particular a pancake coil or a curved planar coil. Use of a flat spiral coil allows a compact design that is robust and inexpensive to manufacture. Use of a helical induction coil advantageously allows for generating a homogeneous alternating magnetic field. As used herein a "flat spiral coil" means a coil that is generally planar, wherein the axis of winding of the coil is normal to the surface in which the coil lies. The flat spiral induction coil can have any desired shape within the plane of the coil. For example, the flat spiral coil may have a circular shape or may have a generally oblong or rectangular shape. However, the term "flat spiral coil" as used herein covers both, coils that are planar as well as flat spiral coils that are shaped to conform to a curved surface. For example, the induction coil may be a "curved" planar coil arranged at the circumference of a preferably cylindrical coil support, for example ferrite core. Furthermore, the flat spiral coil may comprise for example two layers of a four-turn flat spiral coil or a single layer of four-turn flat spiral coil. The at least one induction coil may be held within one of a main body or a housing of the aerosol-generating device.

The aerosol-generating article may be configured such that the inductively heatable liquid conduit—if present—is arranged off-center with regard to a symmetry axis of the alternating magnetic field generated by the induction source when the article is received in the receiving cavity of the aerosol-generating device. As described above, due to the off-center arrangement, that is, an asymmetric arrangement, the liquid conduit is arranged in a region of the alternating magnetic field having a higher field density as compared to a symmetric center arrangement. As a consequence, the heating efficiency is enhanced.

The induction source may comprise an alternating current (AC) generator. The AC generator may be powered by a power supply of the aerosol-generating device. The AC generator is operatively coupled to the at least one induction coil. In particular, the at least one induction coil may be integral part of the AC generator. The AC generator is configured to generate a high frequency oscillating current to be passed through the at least one induction coil for generating an alternating magnetic field. The AC current may be supplied to the at least one induction coil continuously following activation of the system or may be supplied intermittently, such as on a puff by puff basis.

Preferably, the induction source comprises a DC/AC converter connected to the DC power supply including an LC network, wherein the LC network comprises a series connection of a capacitor and the inductor.

The induction source preferably is configured to generate a high-frequency magnetic field. As referred to herein, the high-frequency magnetic field may be in the range between 500 kHz (kilo-Hertz) to 30 MHz (Mega-Hertz), in particular between 5 MHz (Mega-Hertz) to 15 MHz (Mega-Hertz), preferably between 5 MHz (Mega-Hertz) and 10 MHz (Mega-Hertz).

The aerosol-generating device may further comprise a controller configured to control operation of the heating process, preferably in a closed-loop configuration, in particular for controlling heating of the aerosol-forming liquid to a pre-determined operating temperature. The operating temperature used for heating the aerosol-forming liquid may be in a range between 100 degree Celsius and 300 degree Celsius, in particular between 150 degree Celsius and 250 degree Celsius, for example 230 degree Celsius. These temperatures are typical operating temperatures for heating but not combusting the aerosol-forming substrate.

The controller may be or may be art of an overall controller of the aerosol-generating device. The controller may comprise a microprocessor, for example a programmable microprocessor, a microcontroller, or an application specific integrated chip (ASIC) or other electronic circuitry capable of providing control. The controller may comprise further electronic components, such as at least one DC/AC inverter and/or power amplifiers, for example a Class-C power amplifier or a Class-D power amplifier or Class-E power amplifier. In particular, the induction source may be part of the controller.

The aerosol-generating device may comprise a power supply, in particular a DC power supply configured to provide a DC supply voltage and a DC supply current to the induction source. Preferably, the power supply is a battery such as a lithium iron phosphate battery. As an alternative, the power supply may be another form of charge storage device such as a capacitor. The power supply may require recharging, that is, the power supply may be rechargeable. The power supply may have a capacity that allows for the storage of enough energy for one or more user experiences. For example, the power supply may have sufficient capacity to allow for the continuous generation of aerosol for a period of around six minutes or for a period that is a multiple of six minutes. In another example, the power supply may have sufficient capacity to allow for a predetermined number of puffs or discrete activations of the induction source.

In case of an inductively heating aerosol-generating device, the aerosol-generating device may further comprise a flux concentrator arranged around at least a portion of the induction coil and configured to distort the alternating magnetic field of the at least one inductive source towards receiving cavity. Thus, when the article is received in the receiving cavity, the alternating magnetic field is distorted towards the inductively heatable liquid conduit, if present. Preferably, the flux concentrator comprises a flux concentrator foil, in particular a multi-layer flux concentrator foil.

Further features and advantages of the aerosol-generating system according to the present invention have already been described with regard to the aerosol-generating article according to the present invention and thus equally apply.

According to the invention, there is also provided method of manufacturing an aerosol-generating article according to the present invention and as described herein. The method comprises:

extruding the open-ended hollow-cylindrical reservoir body, wherein the reservoir body has a fixed cross-sectional profile along the longitudinal axis of the reservoir body;

providing the first end cap and the second end cap; and attaching the first end cap to the first end of the reservoir body and attaching the second end cap to the second end of the reservoir body.

As described before, the tubular outer wall and the inner partition wall may be manufactured as separate parts by extrusion. Subsequently, the extruded inner partition wall may be installed between two opposing inner portions of the extruded tubular outer wall such as to partition the inner void of the reservoir body into first compartment and a second compartment. Alternatively, the reservoir body as a whole may be extruded in one. That is, the tubular outer wall and the inner partition wall may be extruded together in one such as to be integral with each other. Accordingly, extruding the open-ended hollow-cylindrical reservoir body may result in a one-piece extruded reservoir body.

The main advantages of extrusion over other manufacturing processes are its ability to create very complex cross-sections, and to work materials that are brittle, because the material only encounters compressive and shear stresses during the extrusion presses. Extrusion also forms parts with an excellent surface finish.

In general, extrusion may be continuous or semi-continuous. Semi-continuous extrusion allows for a direct manufacturing of many individual pieces. In contrast, continues extrusion allows for the production of a continuous body profile, which subsequently may be separated into individual bodies, for, by cutting. Hence, extruding the open-ended hollow-cylindrical reservoir body may include extruding the open-ended hollow-cylindrical reservoir body by continuous extrusion or by semi-continues extrusion.

Attaching the first end cap to the first end of the reservoir body and attaching the second end cap to the second end of the reservoir body may comprise attaching the respective end cap to the respective end of the reservoir body by at least one of a form fit, a force fit or an adhesive bond. In particular, attaching the first end cap to the first end of the reservoir body may comprise at least one of clamping, latching, welding or gluing the first end cap to the first end of the reservoir body. Likewise, attaching the second end cap to the second end of the reservoir body may comprise at least one of clamping, latching, welding or gluing the second end cap to the second end of the reservoir body. Welding may include in particular laser welding or ultrasound welding.

The method may further comprise filling an aerosol-forming liquid into the first compartment after attaching at least one of the first end cap to the first end of the reservoir body or the second end cap to the second end of the reservoir body, respectively. Preferably, filling an aerosol-forming liquid into the first compartment may occur prior to attaching the respective other one of the first end cap and the second end cap to the first end and the second end of the reservoir body, respectively.

The method may further comprise rounding an end face of the partition wall at the second end of the reservoir body prior to attaching the second end cap to the second end of the reservoir body. As described further above, rounding the end face of the partition wall may facilitate the fluid flow around the end of the partition wall facing the bottom end cap.

Further features and advantages of the method according to the present invention have already been described with regard to the aerosol-generating article and aerosol-generating system according to the present invention and thus equally apply.

The invention is defined in the claims. However, below there is provided a non-exhaustive list of non-limiting examples. Any one or more of the features of these examples may be combined with any one or more features of another example, embodiment, or aspect described herein.

Example Ex1: An aerosol-generating article for use with an aerosol-generating device, the article comprising:

an open-ended tubular, in particular hollow-cylindrical reservoir body comprising a tubular outer wall and an inner partition wall extending between two opposing inner portions of the tubular outer wall such as to partition the inner void of the reservoir body into a first compartment and a second compartment, wherein the first compartment and the second compartment are laterally arranged adjacent to each other along the longitudinal axis of the hollow-cylindrical reservoir body;

a first end cap attached to a first end of the reservoir body which sealingly closes at least the first compartment at the first end of the reservoir body;

a second end cap attached to a second end of the reservoir body which sealingly closes the first compartment and the second compartment at the second end of the reservoir body, wherein the second end cap comprises a fluid passage providing a fluid communication between the first compartment and the second compartment.

Example Ex2: The aerosol-generating article according to example Ex1, the inner partition wall is parallel to the longitudinal axis of the reservoir body.

Example Ex3: The aerosol-generating article according to example Ex2, wherein the reservoir body is an extruded body, in particular a one-piece extruded body.

Example Ex4: The aerosol-generating article according to any one of the preceding examples, wherein an arrangement of the inner partition wall within the tubular outer wall is asymmetric with respect to a cross-section of the reservoir body perpendicular to the longitudinal axis of the reservoir body.

Example Ex5: The aerosol-generating article according to any one of the preceding examples, wherein a length extension of the inner partition wall in a direction parallel to the longitudinal axis of the reservoir body is smaller or equal to a length extension of the tubular outer wall.

Example Ex6: The aerosol-generating article according to any one of the preceding examples, wherein the first end cap comprises an outlet providing a fluid communication between the second compartment and the outside of the article.

Example Ex7: The aerosol-generating article according to example Ex6, further comprising a filter arranged in or attached to the outlet.

Example Ex8: The aerosol-generating article according to any one of the preceding examples, wherein the first end cap is formed as a mouthpiece.

Example Ex9: The aerosol-generating article according to any one of the preceding examples, wherein the reservoir body is made of plastics, in particular one of PET (polyethylene terephthalate), PP (polypropylene), PE (polyethylene) or PEEK (polyether ether ketone).

Example Ex10: The aerosol-generating article according to any one of the preceding examples, wherein at least one of the first end cap and the second end cap is made of one of silicone, PET (polyethylene terephthalate), PP (polypropylene), PE (polyethylene).

Example Ex11: The aerosol-generating article according to any one of the preceding examples, wherein the first end cap is attached to the reservoir body by at least one of a form fit, a force fit or an adhesive bond.

Example Ex12: The aerosol-generating article according to any one of the preceding examples, wherein the second end cap is attached to the reservoir body by at least one of a form fit, a force fit or an adhesive bond.

Example Ex13: The aerosol-generating article according to any one of the preceding examples, wherein the second end cap comprises a recess or a channel providing a fluid communication between the first compartment and the second compartment.

Example Ex14: The aerosol-generating article according to any one of the preceding examples, wherein a maximum dimension of the second compartment between two opposing portions of the partition wall and the tubular outer wall is in range between 0.2 millimeter and 5 millimeter, in particular between 0.5 millimeter and 3 millimeter, preferably between 1 millimeter and 2.5 millimeter.

Example Ex15: The aerosol-generating article according to any one of the preceding examples, wherein the volume of the first compartment is larger than a volume of the second compartment.

Example Ex16: The aerosol-generating article according to any one of the preceding examples, wherein the volume of the second compartment is at most 50 percent, in particular at most 40 percent, preferably at most 30 percent, more preferably at most 20 percent of the volume of the first compartment.

Example Ex17: The aerosol-generating article according to any one of the preceding examples, further comprising a bushing arranged within the second compartment transverse, in particular perpendicular to the longitudinal axis of the reservoir body, wherein the bushing partitions the second compartment into a vaporization zone and a buffer reservoir.

Example Ex18: The aerosol-generating article according to example Ex17, further comprising a liquid conduit passing through the bushing for delivering aerosol-forming liquid from the buffer reservoir to the vaporization zone.

Example Ex19: The aerosol-generating article according to example Ex18, wherein the liquid conduit passes into the vaporization zone or faces the vaporization zone.

Example Ex20: The aerosol-generating article according to any one of examples Ex18 to Ex19, wherein the liquid conduit comprises a wick element, in particular a filament bundle, preferably an unstranded filament bundle, or a mesh.

Example Ex21: The aerosol-generating article according to any one of examples Ex18 to Ex20, wherein the liquid conduit is inductively heatable.

Example Ex22: The aerosol-generating article according to any one of examples Ex18 to Ex21, wherein the liquid conduit comprises a liquid-conveying susceptor assembly.

Example Ex23: The aerosol-generating article according to any one of examples Ex18 to Ex22, wherein the buffer reservoir comprises a total volume of up to 60 cubic millimeters, in particular up to 50 cubic millimeters, preferably up to 40 cubic millimeters, more preferably up to 30 cubic millimeters, most preferably up to 20 cubic millimeters.

Example Ex24: The aerosol-generating article according to any one of examples Ex18 to Ex23, wherein the buffer reservoir comprises a total volume of at least 5 cubic millimeters, in particular at least 10 cubic millimeters, preferably at least 15 cubic millimeters.

Example Ex25: The aerosol-generating article according to any one of the preceding examples, wherein an end face of the partition wall at the second end of the reservoir body is rounded.

Example Ex26: The aerosol-generating article according to any one of the preceding examples, further comprising an aerosol-forming liquid contained at least in the first compartment.

Example Ex27: The aerosol-generating article according to any one of the preceding examples, wherein the reservoir body has a circular, an ellipsoidal, an oval, a triangular, a rectangular, a quadratic, a hexagonal or a polygonal outer cross-sectional shape.

Example Ex28: The aerosol-generating article according to any one of the preceding examples, wherein the tubular outer wall has a circular, an ellipsoidal, an oval, a triangular, a rectangular, a quadratic, a hexagonal or a polygonal outer cross-sectional shape.

Example Ex29: An aerosol-generating system comprising an aerosol-generating device and an aerosol-generating article according to any one of the preceding claims for use with the device.

Example Ex30: A method of manufacturing an aerosol-generating article according to any one of the preceding examples, comprising:

extruding the tubular, in particular open-ended hollow-cylindrical reservoir body, wherein the reservoir body has a fixed cross-sectional profile along the longitudinal axis of the reservoir body;

providing the first end cap and the second end cap; and attaching the first end cap to the first end of the reservoir body and attaching the second end cap to the second end of the reservoir body.

Example Ex31: The method according to example Ex30, wherein attaching the first end cap to the first end of the reservoir body includes attaching the first end cap to the first end of the reservoir body by at least one of a form fit, a force fit or an adhesive bond.

Example Ex32: The method according to any one examples Ex30 or Ex31, wherein attaching the second end cap to the second end of the reservoir body includes attaching the second end cap to the second end of the reservoir body by at least one of a form fit, a force fit or an adhesive bond.

Example Ex33: The method according to any of examples Ex30 to Ex32, wherein attaching the first end cap to the first end of the reservoir body comprises at least one of clamping, latching, welding or gluing the first end cap to the first end of the reservoir body.

Example Ex34: The method according to any of examples Ex30 to Ex33, wherein attaching the second end cap to the second end of the reservoir body comprises at least one of clamping, latching, welding or gluing the second end cap to the second end of the reservoir body.

Example Ex35: The method according to any one of examples Ex30 to Ex34, further comprising filling an aerosol-forming liquid into the first compartment after attaching at least one of the first end cap to the first end of the reservoir body or the second end cap to the second end of the reservoir body, respectively.

Example Ex36: The method according to example Ex35, wherein filling an aerosol-forming liquid into the first compartment occurs prior to attaching the respective other one of the first end cap and the second end cap to the first end and the second end of the reservoir body, respectively.

Example Ex37: The method according to any one of examples Ex30 to Ex36, further comprising rounding an end face of the partition wall at the second end of the reservoir body prior to attaching the second end cap to the second end of the reservoir body.

Examples will now be further described with reference to the figures in which:

FIG. 1 schematically illustrates a first embodiment of an aerosol-generating article according to the present invention;

Figure 1:
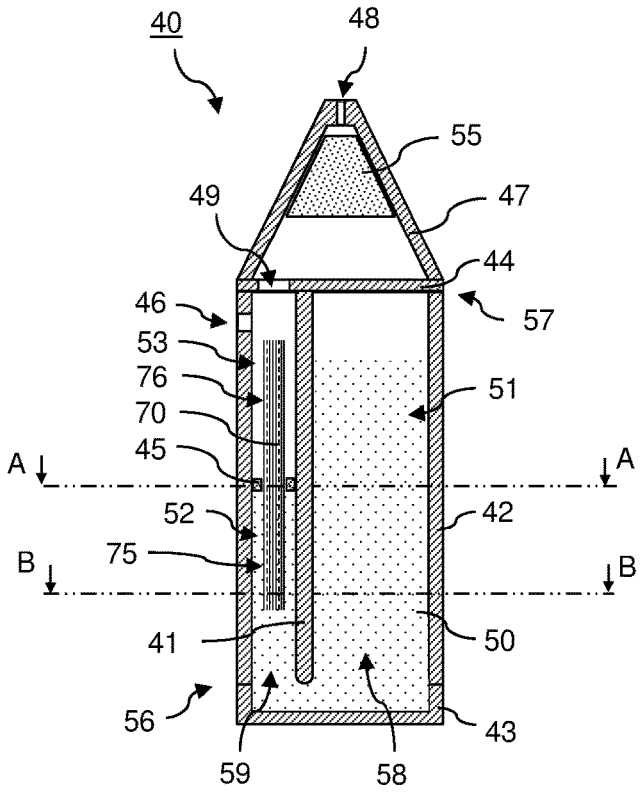
Figure 4:
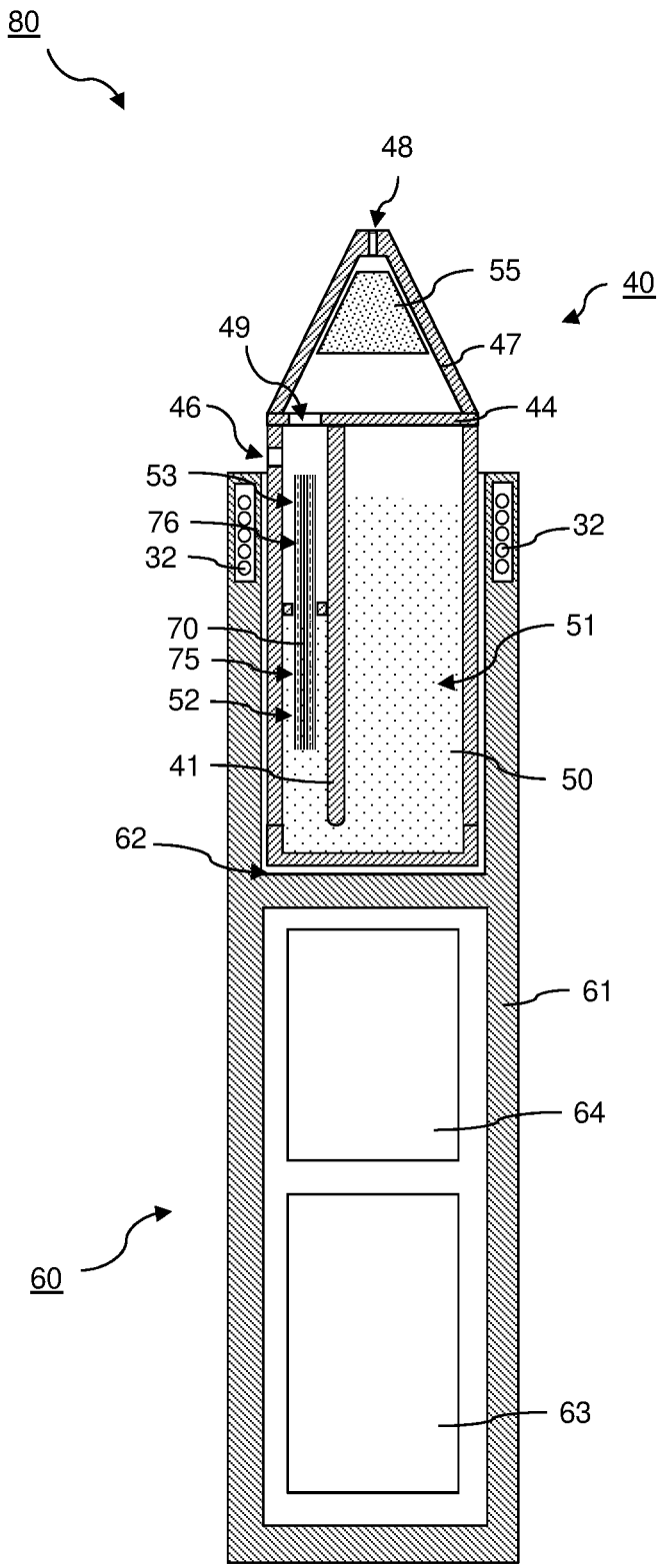
Figure 5:
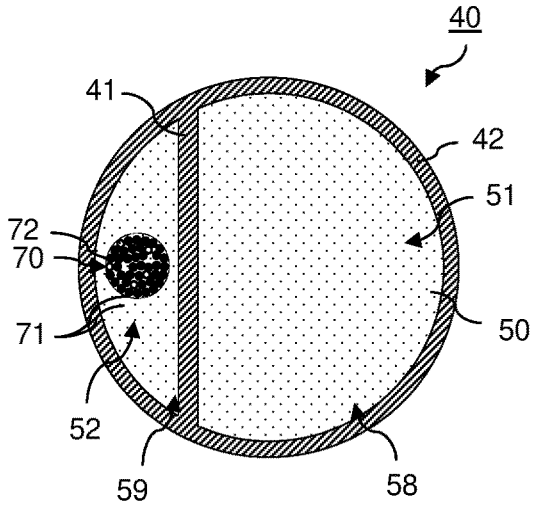
Figure 6:
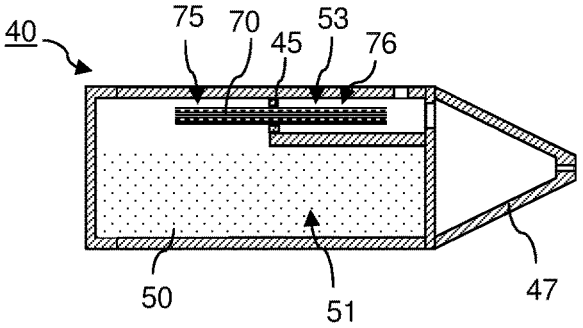
Figure 7:
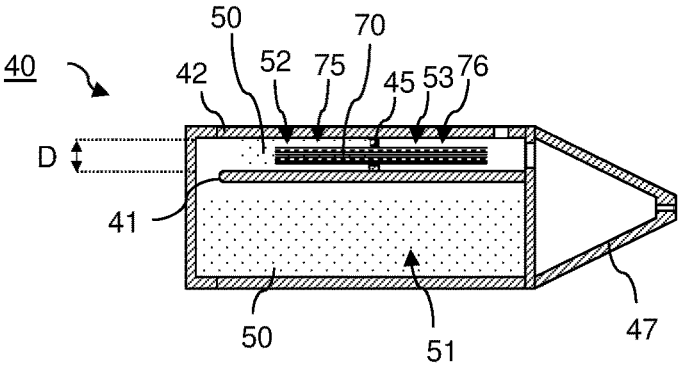
Figure 8:
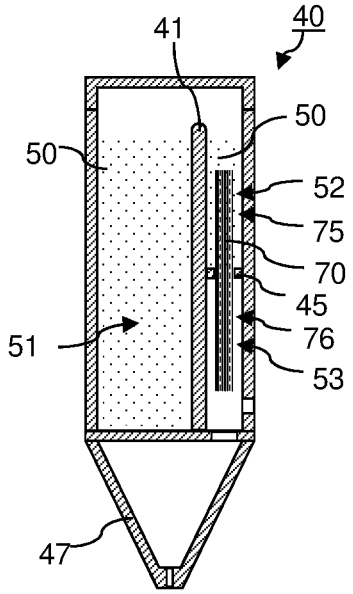
Figure 9:
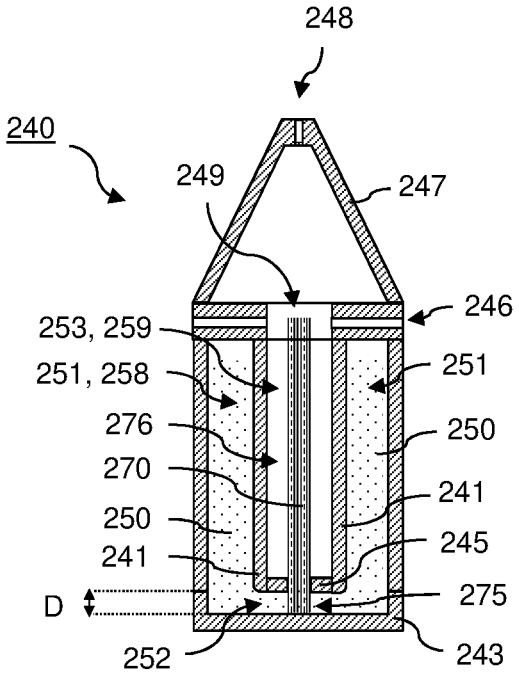
Figure 10:
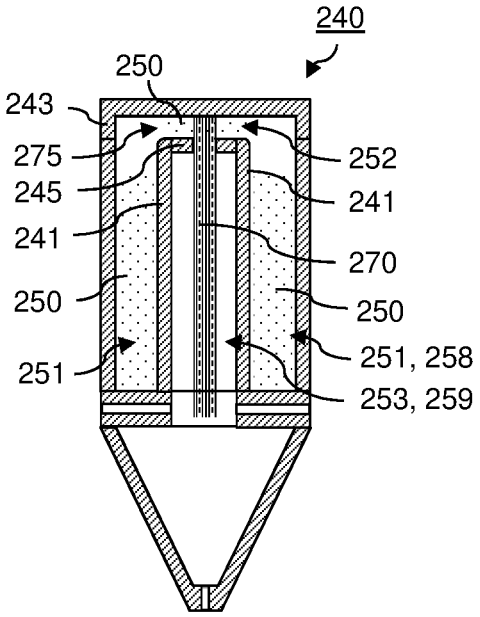

FIG. 4 schematically illustrates an exemplary embodiment of an aerosol-generating system according to the present invention, comprising the article according to FIG. 1 and an aerosol-generating device for use with the article;

FIG. 5 shows a cross-section through an alternative embodiment of the aerosol-generating article according to FIG. 1;

FIG. 6 shows the aerosol-generating article similar to the article shown in FIG. 1, yet without a partition wall;

FIG. 7 shows the aerosol-generating article according to FIG. 1 in a substantially horizontal position;

FIG. 8 shows the aerosol-generating article according to FIG. 1 in an upside down position;

FIG. 9 schematically illustrates a second embodiment of an aerosol-generating article according to the present invention; and FIG. 10 shows the aerosol-generating article according to FIG. 9 in an upside down position.

FIG. 1 schematically illustrates an aerosol-generating article 40 according to a first embodiment of the present invention. As will be described in more detail further below with regard to FIG. 4, the aerosol-generating article 40 is configured for use with an inductively heating aerosol-generating device in order to vaporize an aerosol-forming liquid 50 provided by the aerosol-generating article 40. The article 40 comprises a substantially cylindrical article housing made of a liquid impermeable rigid material, for example, one of PET (polyethylene terephthalate), PP (polypropylene) or PE (polyethylene). The article housing comprises a hollow-cylindrical outer tubular wall 42, a first end cap 44 and a second end cap 43. The article further comprises a partition wall 41, as part of the article housing, which partitions the inner void of the outer tubular wall 42 into a first compartment 58 and a second compartment 59. Together, the outer tubular wall 42 and the partition wall 41 form a reservoir body according to the present invention. The first compartment 58 and the second compartment 59 are laterally arranged adjacent to each other along the longitudinal axis of the reservoir body. The first compartment 58 serves as a main reservoir 51 for storing aerosol-forming liquid 50. Within the second compartment 59, the article 40 comprises a substantially disc-shaped bushing 45 at about half way of the length extension of the outer tubular wall 42 or the reservoir body, respectively. The bushing 45 separates the inner void of the second compartment into two portions, namely, a vaporization cavity 53 and a capillary buffer reservoir 52 for storing aerosol-forming liquid due to capillary action. This will be described in more detail further below. The first end cap 44 sealingly closes the reservoir body at a first end 57 of the reservoir body. At the opposite second end 56, the reservoir body is closed by the second end cap 43. The second end cap 43 comprises a fluid passage which provides a fluid communication between the first compartment 58 and the second compartment 59, and thus between the capillary buffer reservoir 52 and the main reservoir 51. The fluid passage is formed by a recess in the second end cap 43. As can be seen in FIG. 1, the recess is formed such that the main reservoir 51 directly opens out into the capillary buffer reservoir 52 allowing aerosol-forming liquid 50 to freely flow from the main reservoir 51 into the capillary buffer reservoir 52. To facilitate the fluid flow around the free end of the partition wall 41 facing the second end cap 43, the free end of the partition wall 41 comprises rounded edges.

Figure 2:
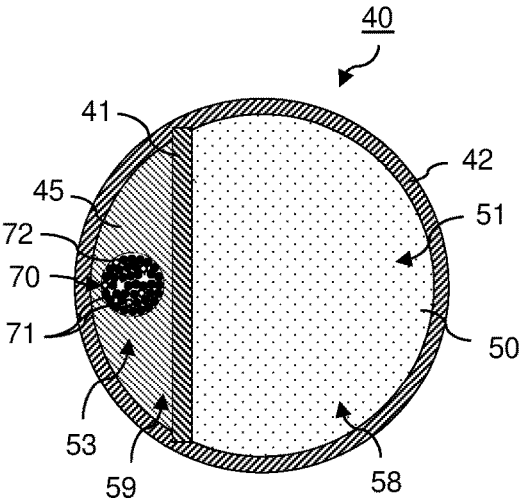
FIG. 2 shows a cross-section through the aerosol-generating article according to FIG. 1 along line A-A.
Figure 3:
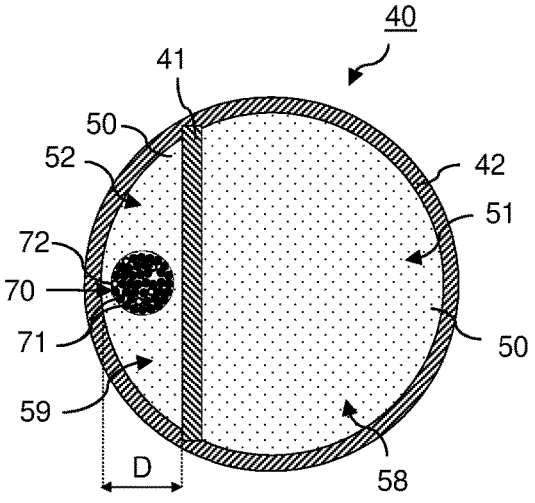
FIG. 3 shows a cross-section through the aerosol-generating article according to FIG. 1 along line B-B.

As can be seen in FIG. 2 and FIG. 3, which show a cross-section through the aerosol-generating article according to FIG. 1 along line A-A and line B-B, respectively, the inner partition wall 41 is separate from the tubular outer wall 42. Preferably, the tubular outer wall 42 and the partition wall 41 are manufactured separately from each other by extrusion. Subsequently, the tubular outer wall 42 and the partition wall 41 may be assembled such as to form a reservoir body according to the present invention. As can be further seen in FIG. 2 and FIG. 3, the inner partition wall 41 is installed between two opposing inner portions of the tubular outer wall 42 parallel to a center axis of the tubular outer wall 42, yet asymmetrically such as to partition the inner void of the reservoir body into a first compartment 58 and a second compartment 59 which is smaller than the first compartment. In this configuration, the tubular outer wall 42 and the partition wall 41 may be attached to each other by an adhesive bond, for example, by welding or gluing. Advantageously, adhesive bond provides a sealing between the first compartment 58 and the second compartment 59, where the partition wall 41 and the tubular outer wall 42 come together.

Alternatively, as shown in FIG. 5, the inner partition wall 41 and the tubular outer wall 42 may be integral with other. In this configuration, the tubular outer wall 42 and the partition wall 41 may also manufactured together by extrusion, resulting in a one-piece extruded reservoir body. Advantageously, a one-piece extruded reservoir body is particularly easy and inexpensive to manufacture. Even more, a one-piece extruded reservoir body does not require a sealing between the first compartment 58 and the second compartment 59, where the partition wall 41 and the tubular outer wall 42 come together.

In general, the aerosol-generating article 40 may be an aerosol-generating article for single use or an aerosol-generating article for multiple uses. In the latter case, the aerosol-generating article 40 may be refillable. That is, the main reservoir 51 may be refillable with aerosol-forming liquid 50 after depletion.

The article 40 further comprises a liquid conduit 70 in fluid communication with the capillary buffer reservoir 52 for conveying aerosol-forming liquid 50 from the capillary buffer reservoir 52 into the vaporization cavity 53. As can be particularly seen in FIG. 2 and FIG. 3, the liquid conduit 70 according to the present embodiment is an unstranded filament bundle comprising a plurality of filaments 71, 72 arranged parallel to each other. Due to the arrangement of the filaments 71, 72 in the filament bundle and due to the small diameter of the filaments 71, 72, the liquid conduit 70 comprises capillary channels formed between the filaments 71, 72. These channels provide capillary action along the length extension of the liquid conduit 70, thus allowing for conveying aerosol-forming liquid 50 from the capillary buffer reservoir 52 into the vaporization cavity 53.

In addition to the liquid conveying property, the liquid conduit 70 of the present embodiment is also configured for inductive heating. For that purpose, the liquid conduit 70 comprises at least a plurality of first filaments 71 including a first susceptor material that is optimized with regard to heat generation. The liquid conduit 70 may also comprises a plurality of second filaments 72 including a second susceptor material which serves as temperature marker, as described further above. Due to the susceptive nature of the filament materials, the liquid conduit 70 is capable to be inductively heated in an alternating magnetic field and thus to vaporize aerosol-forming liquid in thermal contact with the filaments 71, 72. The liquid conduit 70 thus is capable to perform two functions: conveying and heating aerosol-forming liquid. For this reason, the liquid conduit may also be denoted as a liquid-conveying susceptor assembly.

As can be seen in FIG. 1, the liquid conduit 70 passes through an opening in the bushing 45 such that a first portion of the liquid conduit 70 is arranged in the buffer reservoir 52 and a second portion is arranged in the vaporization cavity 53. The opening through the bushing 45 serves not only as a feedthrough for the liquid conduit, but also for bundling the filaments 71, 72, that is, for keeping the filaments 71, 72 together. Furthermore, the opening serves to fix the position of the liquid conduit 70 relative to the article housing. As can be further seen in FIG. 2 and FIG. 3, the filament bundle of the liquid conduit 70 has a substantially circular cross-section which is particularly easy to manufacture.

As the first portion of the liquid conduit 70 is arranged in the buffer reservoir 52 and thus immersed in aerosol-forming liquid 50, it acts as a soaking section 75 for conveying aerosol-forming liquid 50 from the buffer reservoir 52 to the second portion of the liquid conduit 70. In the vaporization cavity 53, the second portion acts at least partially as a heating section 76 for vaporizing aerosol-forming liquid 50 when being exposed to an alternating magnetic field in order to inductively heat the filaments 71, 72. This will be described in more detail below with regard to FIG. 4.

As can be further seen in FIG. 1, the article 40 comprises at least one air inlet 46 through the reservoir body into the vaporization cavity 53 which enables air to enter the vaporization cavity 53. The air inlet 46 may be configured to provide airflow at or around the heating section 76 of the liquid conduit 70. The air inlet 46 may be a hole through the reservoir body. Likewise, the air inlet 46 may be a nozzle that is configured to direct airflow to a specific target location at the liquid conduit 70. In addition, the article 40 comprises a tapered shape mouthpiece 47 which is attached to the first end cap 44 and configured to be taken into a user's mouth for puffing. The mouthpiece 47 further includes a filter 55 and an air outlet 48. The mouthpiece 47 is in fluid communication with the vaporization cavity 53 through an outlet 49 in the first end cap 44. Hence, when a user takes a puff at the mouthpiece 47, air is drawn into the vaporization cavity 53 through the air inlet 46. From there, the air passes through the aperture 49 into the mouthpiece 47 and further through the filter 55 and the air outlet 48 into a users' mouth. In the vaporization cavity 53, aerosol-forming liquid vaporized from the heating section 76 of the liquid conduit 70 is exposed to the air passing through the article 40 such as to form an aerosol which may then be drawn out through the mouthpiece 47.

FIG. 4 schematically illustrates an aerosol-generating system 80 according to an exemplary embodiment of the present invention. The system 80 comprises an aerosol-generating article 40 as shown in FIG. 1-3 as well as an electrically operated aerosol-generating device 60 that is capable of interacting with the article 40 in order to generate an aerosol. For this, the aerosol-generating device 60 comprises a receiving cavity 62 formed within the device housing 61 at a proximal end of the device 60. The receiving cavity 62 is configured to removably receive at least a portion of the aerosol-generating article 40. In particular, the aerosol-generating device is configured to inductively heat the heating section 76 of the liquid conduit 70 in order to vaporize aerosol-forming liquid 50 that is conveyed from the capillary buffer reservoir 52 via the soaking section 75 to the heating section 76 in the vaporization cavity 53. For this, the aerosol-generating device 60 comprises an induction source including an induction coil 32. In the present embodiment, the induction coil 32 is a single helical coil which is arranged and configured to generate a substantially homogeneous alternating magnetic field within the receiving cavity 62. As can be seen in FIG. 4, the induction coil 32 is arranged around the proximal end portion of the receiving cavity 62 such as to only surround the heating section 76 of the liquid conduit 70 when the aerosol-generating article 40 is received in the receiving cavity 62. Accordingly, in use of the device 60, the induction coil 32 generates an alternating magnetic field that only penetrates the heating section 76 of the liquid conduit 70 in the vaporization cavity 53 of the article 40. In contrast, due to the local heating, the soaking section 75 of the liquid conduit 70 stays at temperatures below the vaporization temperature. Thus, boiling of aerosol-forming liquid 50 within the capillary buffer reservoir 52 and the main reservoir 51 is prevented. Hence, in use the liquid conduit 70 comprises a temperature profile along its length extension with sections of higher and lower temperatures. More specifically, the temperature profile shows a temperature increase from temperatures below a vaporization temperature T_vap of the aerosol-forming liquid 50 in the soaking section 75 to temperatures above the respective vaporization temperature in the heating section 76.

The actual temperature profile forming up in use of the susceptor assembly 10 depends on the thermal conductivity and the length of the liquid conduit 70. Accordingly, in order to have sufficient temperature gradient between the soaking sections 75 and the heating section 76, the liquid conduit 70 requires a certain total length. With regard to the present embodiment, the total length of the liquid conduit 70 may be in a range between 5 millimeter and 50 millimeter, in particular between 10 millimeter and 40 millimeter, preferably between 10 millimeter and 30 millimeter, more preferably between 10 millimeter and 20 millimeter.

The liquid conduit 70 is arranged off-center with regard to the geometrical center axis of the aerosol-generating article 40. Due to this, the liquid conduit 70 is arranged off-center with regard to the symmetry axis of the alternating magnetic field generated by the induction coil 32 when the article 40 is received in the cavity 62 of the device 60. Advantageously, due to the off-center arrangement, the liquid conduit 70 is arranged in a region of the alternating magnetic field having a higher field density as compared to a symmetric center arrangement. As a consequence, the heating efficiency is enhanced.

The aerosol-generating device 60 further comprises a controller 64 for controlling operation of the aerosol-generating system 80, in particular for controlling the heating operation. Furthermore, the aerosol-generating device 60 comprises a power supply 63 providing electrical power for generating the alternating magnetic field. Preferably, the power supply 63 is a battery such as a lithium iron phosphate battery. The power supply 63 may have a capacity that allows for the storage of enough energy for one or more user experiences. Both, the controller 64 and the power supply 63 arranged in a distal portion of the aerosol-generating device 60.

The function of the capillary buffer reservoir 52 will now be described in more detail with regard to FIG. 6, FIG. 7 and FIG. 8. FIG. 6 shows the aerosol-generating article 40 according to FIG. 1, yet without comprising a capillary buffer reservoir. Further in contrast to FIG. 1, FIG. 6 shows the article 40 in a substantially horizontal orientation. Due to the different orientation, the aerosol-forming liquid 50 in the article 40 is re-distributed in such a way that—depending on the fluid level—the liquid conduit 70 is not in contact with the aerosol-forming liquid 50 anymore. As a consequence, the delivery of aerosol-forming liquid to the vaporization zone 53 is interrupted which causes a rapid decrease or even outage of aerosol formation if the article was used in this orientation for a certain time. The purpose of the buffer reservoir 52 is to remedy this. Basically, the buffer reservoir 52 provides a small volume reservoir that is in fluid communication with the main reservoir 51 and the liquid conduit 70 and configured to trap a certain amount of aerosol-forming liquid due to capillary action independent of the article orientation. For this, at least one dimension of the capillary buffer reservoir 52 is chosen to be on the order of the effective capillary length, which typically is in the range of a few millimeters for most liquids. In the present embodiment, the capillary action of the buffer reservoir 52 is caused by the fact that the maximum distance D between opposing portions of the partition wall 41 and the inner surface of the tubular outer wall 42 is in a range of a few millimeters only, as indicated in FIG. 3 and FIG. 7. For example, the maximum distance D may be in a range between 1 millimeter and 5 millimeter. Due to this, capillary effects dominate over gravity in the capillary buffer reservoir 52. As a consequence, once aerosol-forming liquid 50 filled in the buffer reservoir 52, it is prevented from flowing back into the main reservoir 51 when the orientation of the article is changed, for example, when the article 40 is turned from a substantially upright position as shown in FIG. 1 into a substantially horizontal position as shown FIG. 7, or even into an upside down position as shown in FIG. 8. Hence, independent of the article orientation, the buffer reservoir 52 reliably traps the liquid aerosol-forming due to the capillary action of its small volume, similar to a buffer reservoir of a fountain pen. Yet, the capillary action along the liquid conduit is still large enough to convey the trapped liquid from the capillary buffer reservoir 52 to the vaporization zone. The volume of the buffer reservoir is chosen such as to provide sufficient liquid available for a few puffs, independent of the article orientation. Accordingly, the total volume of the capillary buffer reservoir 52 may be at least 5 cubic millimeters, in particular at least 10 cubic millimeters, preferably at least 15 cubic millimeters.

FIG. 9 and FIG. 10 schematically illustrate a second exemplary embodiment of an aerosol-generating 240 article according to the present invention. In general, the aerosol-generating article 240 according to FIGS. 9 and 10 is similar to the aerosol-generating article 40 shown in FIG. 1. Therefore, identical or similar features are denoted with the same reference signs, yet incremented by 200. In contrast to the article 40 shown in FIG. 1, the article 240 according to FIGS. 9 and 10 comprises a liquid conduit 270, a buffer reservoir 252 and a vaporization zone 253 which are arranged symmetrically with regard to the geometrical center axis of the 40. For this, a cylindrical partition wall 241 is arranged coaxially in a cylindrical tubular outer wall 242 such as to partition the inner void of the cylindrical tubular outer wall 242 into a hollow-cylindrical first compartment 258 and a cylindrical second compartment 259 which is coaxially surrounded by the first compartment 258. While the first compartment 258 forms the hollow-cylindrical main reservoir 251, the second compartment 259 forms the cylindrical vaporization zone 253. A first end cap 244 is attached to a first end of the reservoir body comprising the partition wall 241 and the tubular outer wall 242. The first end cap 244 sealingly closes the first compartment 258 at the first end of the reservoir body. At the opposite end, the reservoir body is closed by a second end cap 243 which comprises a recess similar to the bottom end cap 43 of the article 40 shown in FIG. 1. At a bottom portion, the vaporization cavity 253 is closed by a disc-shaped bushing 245. There, a capillary buffer reservoir 252 is formed between the inner surface of the second end cap 243 on the one side, and the end face of the cylindrical partition wall 241 and the disc-shaped bushing 245 on the other side. That is, the capillary buffer reservoir 252 basically is formed by a part of the recess-like fluid passage in the second end cap 243. The distance D between the inner surface of the bottom end cap 243 and the end face of the cylindrical partition wall 241 and the disc-shaped bushing 245 is chosen to be on the order of the effective capillary length, for example, in a range between 1 millimeter and 5 millimeter. Due to this, once filled with aerosol-forming liquid, the buffer reservoir 252 traps a certain amount of aerosol-forming liquid due to capillary action, even when the orientation of the article 240 is changed, for example, when the article 40 is turned form a substantially upright position as shown in FIG. 9 into an upside down position as shown in FIG. 10. Hence, the soaking section 275 of the liquid conduit 270 is always in contact with aerosol-forming liquid independent of the article position. The volume of the capillary buffer reservoir 252 is chosen such that the trappable amount of aerosol-forming liquid suffices at least for a few puffs.

In the present embodiment, the cylindrical partition wall 241 and the tubular outer wall 242 are separate parts which may be manufactured by extrusion. The first and the second end cap 243, 244 may be used to hold the partition wall 241 and the tubular outer wall 242 together.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A±5% of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. An aerosol-generating article for an aerosol-generating device, the aerosol-generating article comprising:

an open-ended hollow-cylindrical reservoir body comprising a tubular outer wall and an inner partition wall extending between two opposing inner portions of the tubular outer wall so as to partition an inner void of the open-ended hollow-cylindrical reservoir body into a first compartment and a second compartment, wherein the first compartment and the second compartment are laterally arranged adjacent to each other along a longitudinal axis of the open-ended hollow-cylindrical reservoir body;

a first end cap attached to a first end of the open-ended hollow-cylindrical reservoir body that sealingly closes at least the first compartment at the first end of the open-ended hollow-cylindrical reservoir body; and a second end cap attached to a second end of the open-ended hollow-cylindrical reservoir body that sealingly closes the first compartment and the second compartment at the second end of the open-ended hollow-cylindrical reservoir body, wherein the second end cap comprises a fluid passage providing a fluid communication between the first compartment and the second compartment.

2. The aerosol-generating article according to claim 1, wherein the open-ended hollow-cylindrical reservoir body is an extruded body.

3. The aerosol-generating article according to claim 1, wherein the open-ended hollow-cylindrical reservoir body is a one-piece extruded body.

4. The aerosol-generating article according to claim 1, wherein an arrangement of the inner partition wall within the tubular outer wall is asymmetric with respect to a cross-section of the open-ended hollow-cylindrical reservoir body perpendicular to the longitudinal axis of the open-ended hollow-cylindrical reservoir body.

5. The aerosol-generating article according to claim 1, wherein the first end cap comprises an outlet providing a fluid communication between the second compartment and an outside of the aerosol-generating article.

6. The aerosol-generating article according to claim 1, wherein the first end cap is formed as a mouthpiece.

7. The aerosol-generating article according to claim 1, wherein the first end cap and the second end cap are attached to the open-ended hollow-cylindrical reservoir body by at least one of a form fit, a force fit, or an adhesive bond.

8. The aerosol-generating article according to claim 1, wherein the second end cap further comprises a recess or a channel providing a fluid communication between the first compartment and the second compartment.

9. The aerosol-generating article according to claim 1, wherein a maximum dimension of the second compartment between two opposing portions of the inner partition wall and the tubular outer wall is in a range between 0.2 millimeter and 5 millimeters.

10. The aerosol-generating article according to claim 1, wherein a maximum dimension of the second compartment between two opposing portions of the inner partition wall and the tubular outer wall is in a range between 1 millimeter and 2.5 millimeters.

11. The aerosol-generating article according to claim 1, wherein a volume of the second compartment is at most 50 percent of a volume of the first compartment.

12. The aerosol-generating article according to claim 1, wherein a volume of the second compartment is at most 20 percent of a volume of the first compartment.

13. The aerosol-generating article according to claim 1, further comprising a bushing arranged within the second compartment transverse to the longitudinal axis of the open-ended hollow-cylindrical reservoir body, wherein the bushing partitions the second compartment into a vaporization zone and a buffer reservoir.

14. The aerosol-generating article according to claim 1, further comprising a bushing arranged within the second compartment perpendicular to the longitudinal axis of the open-ended hollow-cylindrical reservoir body, wherein the bushing partitions the second compartment into a vaporization zone and a buffer reservoir.

15. The aerosol-generating article according to claim 13, further comprising a liquid conduit passing through the bushing and being configured to deliver aerosol-forming liquid from the buffer reservoir to the vaporization zone.

16. The aerosol-generating article according to claim 15, wherein the liquid conduit is inductively heatable.

17. An aerosol-generating system comprising an aerosol-generating device and an aerosol-generating article according to claim 1 for the aerosol-generating device.

18. A method of manufacturing an aerosol-generating article according to claim 16, the method comprising:

extruding the open-ended hollow-cylindrical reservoir body, wherein the open-ended hollow-cylindrical reservoir body has a fixed cross-sectional profile along the longitudinal axis of the open-ended hollow-cylindrical reservoir body;

providing the first end cap and the second end cap; and attaching the first end cap to the first end of the open-ended hollow-cylindrical reservoir body and attaching the second end cap to the second end of the open-ended hollow-cylindrical reservoir body.

19. The method according to claim 18, further comprising filling an aerosol-forming liquid into the first compartment after attaching at least one of the first end cap to the first end of the open-ended hollow-cylindrical reservoir body or the second end cap to the second end of the open-ended hollow-cylindrical reservoir body, respectively.

* * * * *